US006702907B2

(12) United States Patent
Sato et al.

(10) Patent No.: US 6,702,907 B2
(45) Date of Patent: Mar. 9, 2004

(54) FORGED SCROLL PART AND PRODUCTION PROCESS THEREOF

(75) Inventors: Masahiro Sato, Kitakata (JP); Fumihiko Ohmi, Mt. Sterling, OH (US); Yuichi Ogura, Kitakata (JP)

(73) Assignee: Showa Denko K.K., Tokyo (JP)

( * ) Notice: Subject to any disclaimer, the term of this patent is extended or adjusted under 35 U.S.C. 154(b) by 125 days.

(21) Appl. No.: 10/009,200

(22) PCT Filed: Apr. 9, 2001

(86) PCT No.: PCT/JP01/03052

§ 371 (c)(1),
(2), (4) Date: Mar. 20, 2002

(87) PCT Pub. No.: WO01/77398

PCT Pub. Date: Oct. 18, 2001

(65) Prior Publication Data

US 2003/0005983 A1 Jan. 9, 2003

Related U.S. Application Data

(63) Continuation-in-part of application No. 09/829,011, filed on Apr. 10, 2001, now abandoned.
(60) Provisional application No. 60/230,807, filed on Sep. 7, 2000.

(30) Foreign Application Priority Data

Apr. 10, 2000 (JP) ..... 2000-108269

(51) Int. Cl.[7] ..... C22F 1/043
(52) U.S. Cl. ..... 148/551; 148/692; 148/693; 148/696
(58) Field of Search ..... 148/550, 551, 148/693, 697, 692, 696

(56) References Cited

U.S. PATENT DOCUMENTS 4,908,077 A * 3/1990 Nakamura et al. ..... 148/437
5,993,576 A * 11/1999 Ichinose et al. ..... 148/690

FOREIGN PATENT DOCUMENTS

JP 06-172947 A * 6/1994 ..... C22F/1/043
JP 07-018306 A * 1/1995 ..... B22F/3/24

* cited by examiner

*Primary Examiner*—George Wyszomierski
*Assistant Examiner*—Janelle Combs Morillo
(74) *Attorney, Agent, or Firm*—Sughrue Mion, PLLC

(57) ABSTRACT

A process for producing an aluminum alloy-made forged scroll part includes a step of casting an aluminum alloy material into a round bar having a diameter of 130 mm or less, the aluminum alloy material comprising 8.0–12.5 mass % of Si, 1.0–5.0 mass % of Cu and 0.2–1.3 mass % of Mg; a step of cutting the aluminum alloy round bar into a stock material for forging; a step of subjecting the stock material to upsetting at an upsetting ratio of 20–70% to form a pre-shaped product that is a workpiece; and a forging step of applying pressure onto the workpiece with a punch at a temperature of 300–450° C. to form a scroll wrap in a direction of the punch pressure, and wherein the forging step includes a single step in which a forged scroll part is press-formed while a back pressure smaller than the punch pressure is applied to an end of the scroll wrap in a direction opposite to the punch pressure direction. With this method, it is possible to produce a forged scroll part capable of suppressing occurrence of coarse primary Si crystals and reducing a variation in height of a wrap in a scroll part and in every scroll part being forged.

10 Claims, 6 Drawing Sheets

FORGED SCROLL PART AND PRODUCTION PROCESS THEREOF

CROSS REFERENCE TO RELATED APPLICATIONS

This application is a continuation-in-part application of U.S. application Ser. No. 09/829,011, filed Apr. 10, 2001 now abandoned, which claims the benefit of U.S. Provisional Application Ser. No. 60/230,807, filed on Sep. 7, 2000.

TECHNICAL FIELD

The present invention relates to an aluminum alloy-made forged scroll part for a scroll compressor employed mainly in an air conditioner and to a process for producing the part.

BACKGROUND ART

In recent years, scroll compressors have become of great interest as air conditioner compressors, because, for one reason, such a scroll compressor contains a small number of parts and is driven silently. The scroll compressor includes a fixed scroll having a spiral wrap portion 11 provided on a flange portion 12 as shown in FIG. 2, and an orbiting scroll having a spiral wrap portion whose shape is similar to that of the portion 11, the spiral wrap portion of the orbiting scroll being driven for orbital movement such that these spiral wrap portions face each other in a fitted state.

In many cases, a fixed or orbiting scroll (hereinafter referred to simply as a "scroll") is produced from aluminum alloy in order to reduce the weight of a resultant compressor. The scroll is produced through, for example, casting or forging. In order to provide the scroll with strength and reliability, forging is advantageously carried out for producing the scroll. Since the scroll has a complicated shape, it must be produced through hot forging.

FIG. 3 shows a conventional process for production an aluminum alloy scroll part through forging.

First, an aluminum alloy prepared by mixing alloy components is melted and then cast through continuous casting into a billet (BL) for extrusion having a diameter of 200 mm or more. After the inside of the BL is homogenized through heat treatment, the BL is cut into pieces such that they have an identical length so as to provide round bars each having a predetermined diameter, and each piece is subjected to extrusion to thereby form a round bar (extruded round bar).

Usually, the diameter of the extruded round bar is almost equal to the outer diameter of a forged part. The round bar is cut into pieces, and each piece is employed as a stock material for forging. As will be described below, in order to facilitate production of a scroll part, before forging of the stock material the cut piece may be pre-shaped, if necessary, through forging or machining into a piece having a shape similar to that of the scroll part, so as to employ the pre-shaped piece as a stock material for forging.

The stock material is forged into a scroll part usually through hot forging. In order to provide the forged part with strength, after forging, the part is usually subjected to solution (quenching) and aging heat treatment.

In order to enhance precision in the size of the forged part, a portion of the surface of the part is then subjected to machining, if necessary.

FIG. 4 is a schematic cross-sectional view showing a conventional scroll-forging process. A workpiece 4 placed in a die 2 is pressed downward with a punch 1 to thereby form the wrap portion 11. Usually, the distance that the punch 1 moves is determined to be consistent in order to make the thickness of a flange portion 12 of the scroll consistent.

JP-A-SHO 54-159712, 59-61542 and 62-89545 disclose a process for forging an aluminum alloy-made scroll, in which, in order to precisely forge a workpiece into a scroll wrap, the workpiece is subjected to forging or machining in advance so as to provide the piece with a preliminary shape, and the workpiece is then forged into the scroll wrap. The reason why such a preliminary process is carried out is that since the wrap portion 11 has a spiral shape and large height and is connected to the flange portion 12, when a workpiece is forged into a scroll as shown in FIG. 4, a wrap portion having a uniform height is difficult to form. Therefore, a workpiece having an intermediate shape is formed in advance. The process can provide a produced scroll with a shape with some degree of precision. However, the process requires designing of an intermediate shape which matches the final shape of the scroll, and preparation of a forging die employed for intermediate processing. Consequently, the process includes complicated steps and involves high costs, presenting difficulty in practice.

JP-A-SHO 60-102243 and JP-A-HEI 06-23474, among other publications, disclose a back-pressure forging process in which a workpiece prepared only by cutting a round bar is employed without being subjected to pre-processing before forging and, during forging of the workpiece, a load is applied to the end portion of a scroll wrap 11 in a direction opposite to the forging direction in order to control material flow so as to realize a uniform flow into a wrap-shaped mold and to reduce variation in the height of the scroll wrap 11. According to the process, by using a workpiece prepared only by cutting a round bar, a scroll in which variation in the height of a wrap portion 11 is reduced can be produced at low cost with high productivity.

To be specific, the back-pressure forging process for a scroll is schematically shown in the cross-sectional views of FIGS. 5 and 6. A workpiece 4 is pressed downward with a punch 1 and forged into a wrap formation space 2*a* of a die 2 while the knockouts are retracted to thereby form a wrap 11. During the forging, a load lower than a punch pressure is applied as a back pressure through the wrap formation space 2*a* by means of knock pins 7 and knockouts 6 to the end of the wrap in the direction opposite to that of the forging (FIG. 5). As a result, a scroll part 5 comprising a flange portion 12 with a predetermined thickness L1 and the wrap 11 with a uniform height L2 depending vertically from the flange portion can be formed as shown in FIG. 7.

The back-pressure forging process exerts, to some extent, the effect for making the overall height of a spiral wrap of a forged scroll part uniform.

Although variation in the height of a wrap of a scroll can be regulated to some extent according to the back-pressure forging process, wrap height varies between individual scrolls unless the thickness of individual cut materials, i.e. the weight of individual workpieces, is strictly controlled when cutting the round bar. Therefore, a margin for machining of the end of a wrap must be controlled in every forged part at a post-processing step. Alternatively, in consideration of different wrap heights among scroll products, slightly large-sized scrolls must be forged to provide scrolls with a large margin for machining at a post-processing step. This results in low yield.

In the back-pressure forging process, when a workpiece is forged into a scroll, the thickness L1 of the flange portion 12 is controlled by a stroke of the punch 1, and the remaining portion of the workpiece is forged into a wrap portion. Therefore, difference in the volume of the workpieces before forging is reflected in difference in the height L2 of the wrap portions.

Conventionally, in order to smoothly carry out forging of a workpiece without production loss, the workpiece is prepared by cutting a round bar material having a diameter nearly equal to the outer diameter of a flange portion that will become the maximum outer diameter of a forged scroll. Therefore, variation in the thickness of the cut material is reflected in variation in the volume of the workpiece, i.e. variation in the height of a wrap portion of the scroll.

The horizontal cross-sectional area of a wrap portion is about ⅓ to ⅕ that of a workpiece. Accordingly, the variation in the cut length of the workpiece results in a variation in the height of the wrap portion that is 3 to 5 times the variation in the cut length. Therefore, a margin of the end of the wrap for machining in a post-processing step cannot be reduced because the margin has to include the variation in height. For this reason, a plural number of machining steps are required, resulting in failure to reduce the manhour for machining of scrolls and enhance the material-based yield.

In consideration of conditions under which scrolls are used, an aluminum alloy material containing a large amount of silicon is employed for producing a scroll in order to enhance strength and wear resistance of the scroll. Since the material is hard, a blade for cutting the material is easily worn. Therefore, compared with a conventionally used alloy, variation in the thickness of the aluminum alloy material increases during cutting, greatly affecting variation in wrap height between individual forged scrolls.

In addition, a forging process that can forge a scroll part into a shape approximating to a product shape as well as the wrap height forging has recently been desired. The formation of concave portions in the surface of a flange provided with a wrap as shown in FIG. 8 is accompanied with metal flow toward the wrap and metal interference that result in sand or slag inclusion or other forging defects particularly when forging under the condition not utilizing a back pressure. Therefore, the concave portions cannot be obtained using a one-step forging process, and a plural-step forging process has been adopted in general. Actually, however, a machining process rather than the plural-step forging process has been selected in the formation of concave portions from the standpoint of labor and cost. This incurs machining process cost.

As described above, an aluminum alloy material is employed for producing a scroll in order to reduce the weight of the scroll. In consideration of high strength, high wear resistance and a balance of these to processability, Al—Si alloy materials among a variety of aluminum alloy materials have mainly been developed. When the characteristics of the material are regulated, fine Si particles are uniformly dispersed in an aluminum base in order to impart wear resistance to the material. Development of alloy materials other than Al—Si alloy materials has encountered difficulty to date, and thus such other alloy materials are not employed in practice, and basically modifications of Al—Si alloy materials are carried out.

In an Al—Si alloy material, crystallization of Si particles is indispensable to enhancement of wear resistance of the material. However, crystallization of coarse primary Si crystals having a size of tens of pm or more induces wear of a blade during machining, causing a product to have a rough machined surface. In addition, when such coarse primary Si crystals segregate at a portion of a scroll subjected to high stress, fatigue breakage initiates at that portion when the scroll is employed, greatly impairing reliability of the scroll. Furthermore, as described above, when such an Al—Si alloy material is cut, wear of a blade is accelerated, and thus variation in the thickness of the material increases during cutting.

As described above, in a conventional production process, such an aluminum alloy material is formed, through cutting, into an extrusion round bar material. In order to form the round bar material, the alloy material is usually cast, through continuous casting, into a billet having a relatively large diameter (200 mm or more). Therefore, the billet is solidified slowly during casting, and thus crystallization of coarse primary Si crystals having a size of 100 $\mu$m or more tends to occur, and control of distribution of Si particles in the billet is difficult. Furthermore, when the coarse Si crystals are crystallized in the material as described above, variation in the thickness of the billet may occur during cutting. In addition, primary Si crystals remain in a forged scroll product as a large, hard impurity, and the crystals may cause problems in machining of the forged scroll and reduction in strength thereof.

One object of the present invention is to provide an aluminum alloy-forged scroll part that enables reduction of a variation in wrap height of a scroll part as well as reduction of a variation in height of the wrap portion of a forged product and a process for producing the scroll part.

Another object of the present invention is to provide an aluminum alloy-formed scroll part that enables reduction in a margin for machining in post-processing and suppression of occurrence of coarse primary Si crystals which would cause wear of a blade during machining and reduction in strength of the forged scroll part.

DISCLOSURE OF THE INVENTION

The present invention provides an aluminum alloy-forged scroll part characterized in that it is produced from an aluminum alloy material comprising 8.0–12.5 mass % of Si, 1.0–5.0 mass % of Cu and 0.2–1.3 mass % of Mg, and that the scroll part contains Si particles having a size of less than 15 $\mu$z and a mean size of 3 $\mu$m or less. The Si particles include primary Si particles and eutectic Si particles.

The present invention further provides a process for producing an aluminum alloy-forged scroll part comprising a step of casting an aluminum alloy that comprises 8.0–12.5 mass % of Si, 1.0–5.0 mass % of Cu and 0.2–1.3 mass % of Mg into a round bar having a diameter of 130 mm or less, preferably 85 mm or less, a step of cutting the aluminum alloy round bar into a stock material for forging, a step of subjecting the stock material to upsetting at an upsetting ratio of 20–70% to form a pre-shaped product that is a workpiece, and a forging step of applying pressure onto the workpiece with a punch at a temperature of 300–450° C. to form a scroll wrap in a direction of applying the punch pressure, and wherein the forging step includes a step of applying a back pressure that is lower than the punch pressure to an end of the press-formed scroll wrap in a direction opposite to the punch pressure applying direction.

The aluminum alloy may further comprise 2.0 mass % or less of Ni and/or 0.5 mass % or less of one or more species selected from among Sr, Ca, Na and Sb.

The back pressure may be a constant pressure of 80–240 $N/mm^2$ or comprise an initial pressure of 80–240 $N/mm^2$, a pressure gradually reduced from the initiation of wrap formation and an end pressure of 40 to 120 $N/mm^2$.

The stock material subjected to upsetting may be subjected beforehand to homogenization heat treatment at 480–520° C. for 0.5–4 hours and/or to surface peeling.

The surface of the workpiece subjected to forging may be coated with a lubrication film.

The forged part may be subjected to solution heat treatment (quenching) and aging treatment (quenching, aging and hardening treatment).

Conventionally, when aluminum alloy is to be cast as a billet for ordinary extrusion, the cast billet ordinarily has a large diameter of 200 mm or more. For this reason, the billet is cooled slowly and solidified moderately. When the Si content exceeds 10%, therefore, crystallization of coarse Si crystals having a size of around 100 $\mu$m as primary crystals tends to occur. Even in a small-diameter bar obtained by extrusion of the billet, the crystals tend to remain. While the primary Si crystals are easy to segregate at the center part of a billet that is cooled slowly in particular, they exist at random over the entire lateral cross section of the billet when the Si content approximates to 12%.

In the present invention, however, when forging aluminum alloy into a round bar, the diameter of the forged bar is set to 130 mm or less, as described above. As a result, its cooling speed is considerably higher than that of a billet having a diameter of 200 mm to the effect that its solidifying speed is high. This enables eutectic Si crystals to be made smaller to suppress occurrence of coarse primary Si crystals.

By making the diameter of the circular bar small as described above, occurrence of course primary Si crystals can be suppressed. Therefore, the problem of wear of a blade during machining that would cause deterioration of the quality and reduction in strength of a product can be solved. In addition, the small diameter of the circular bar can reduce a margin for machining of post-processing, resulting in an economical advantage.

Further, the present invention has two features, one of which is to carry out forging using a back pressure two to four times the general back pressure for the purpose of promoting preferential formation of a flange portion. The other feature is to control the formation process by varying the back pressure stepwise in accordance with the forging process, while it is general to apply a constant pressure at the forging step in the back-pressure forging. These features enable reduction of a variation in height of a wrap in a scroll part and in every scroll part being forged.

BEST MODES FOR CARRYING OUT THE INVENTION

Figure 1:
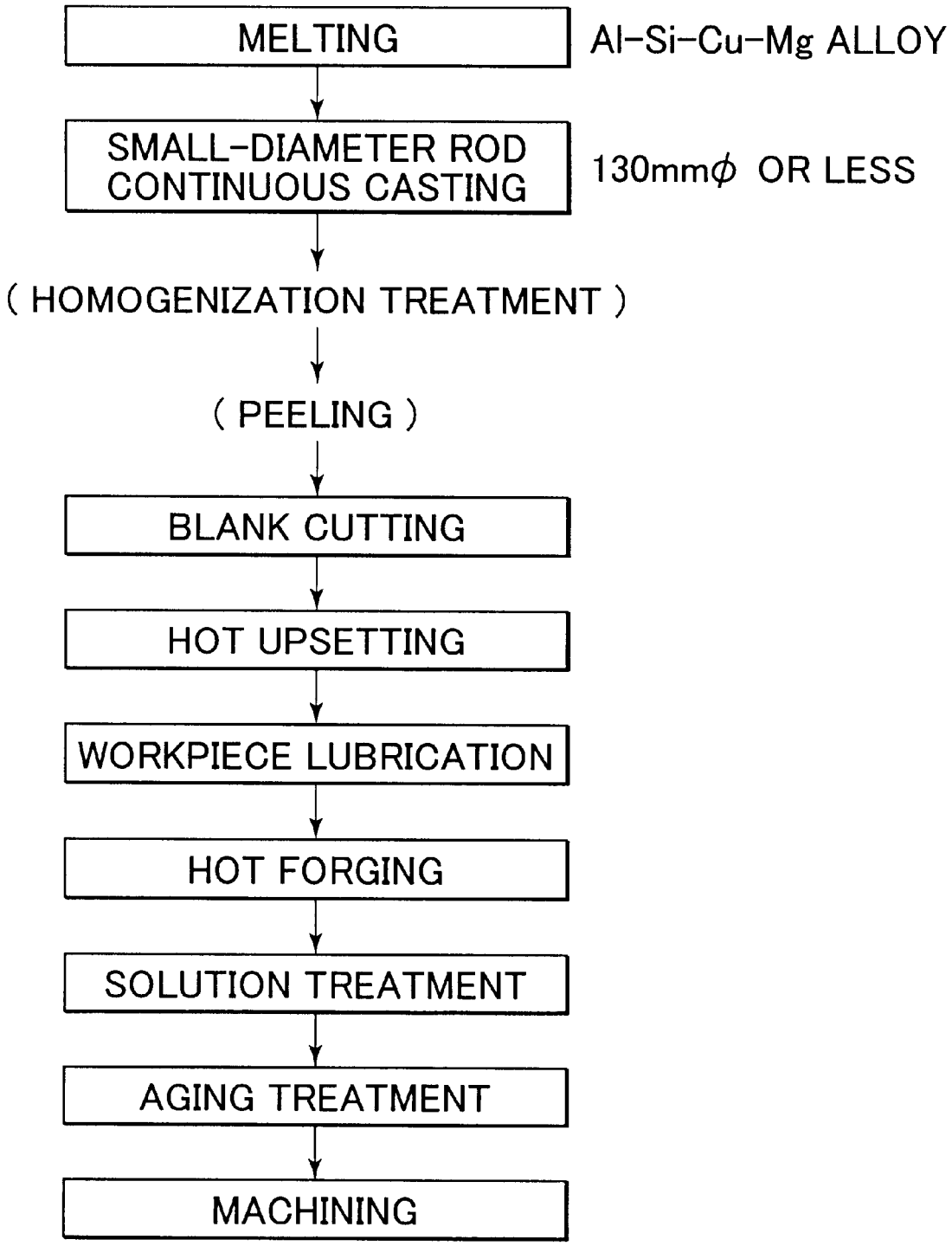
FIG. 1 is a flow chart showing a process for producing a forged scroll part according to the present invention.
Figure 2:
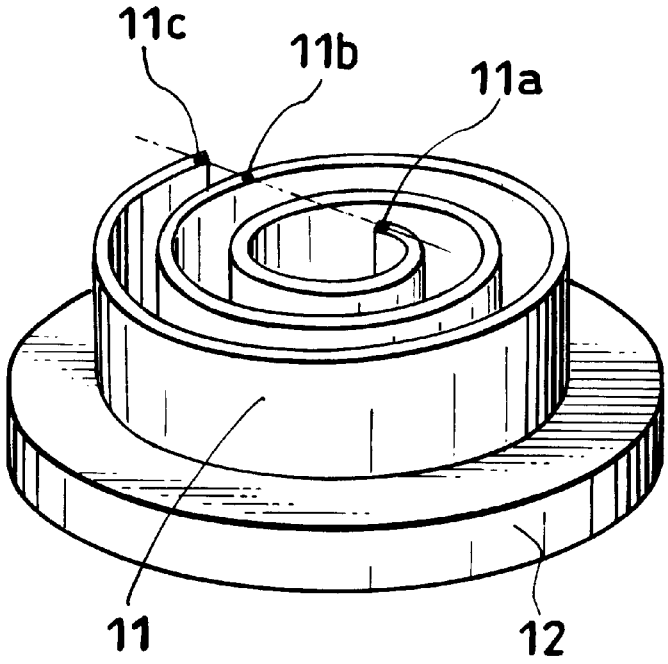
FIG. 2 is a perspective view showing one example of a forged scroll part.
Figure 4:
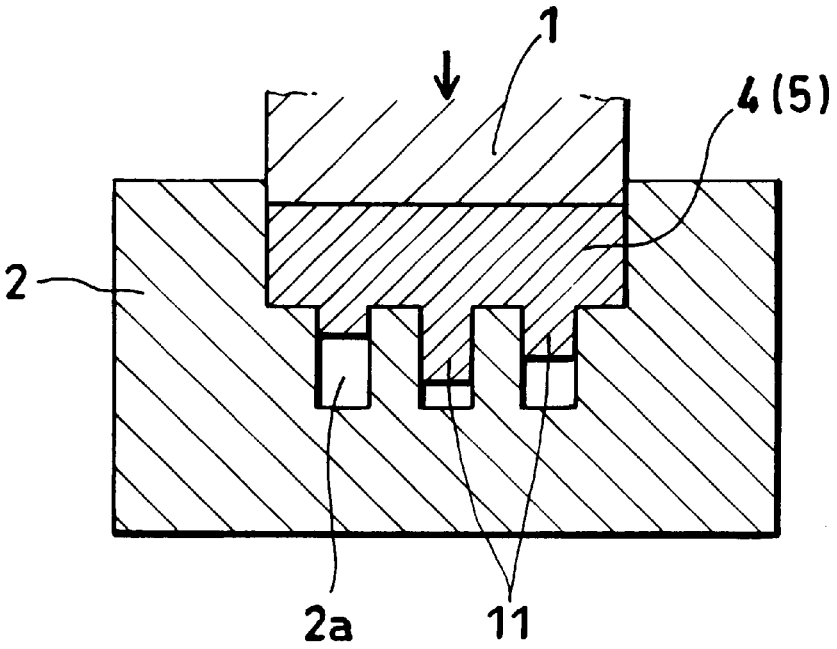
FIG. 4 is a cross section showing one example of a conventional forging process for a scroll part.
Figure 3:
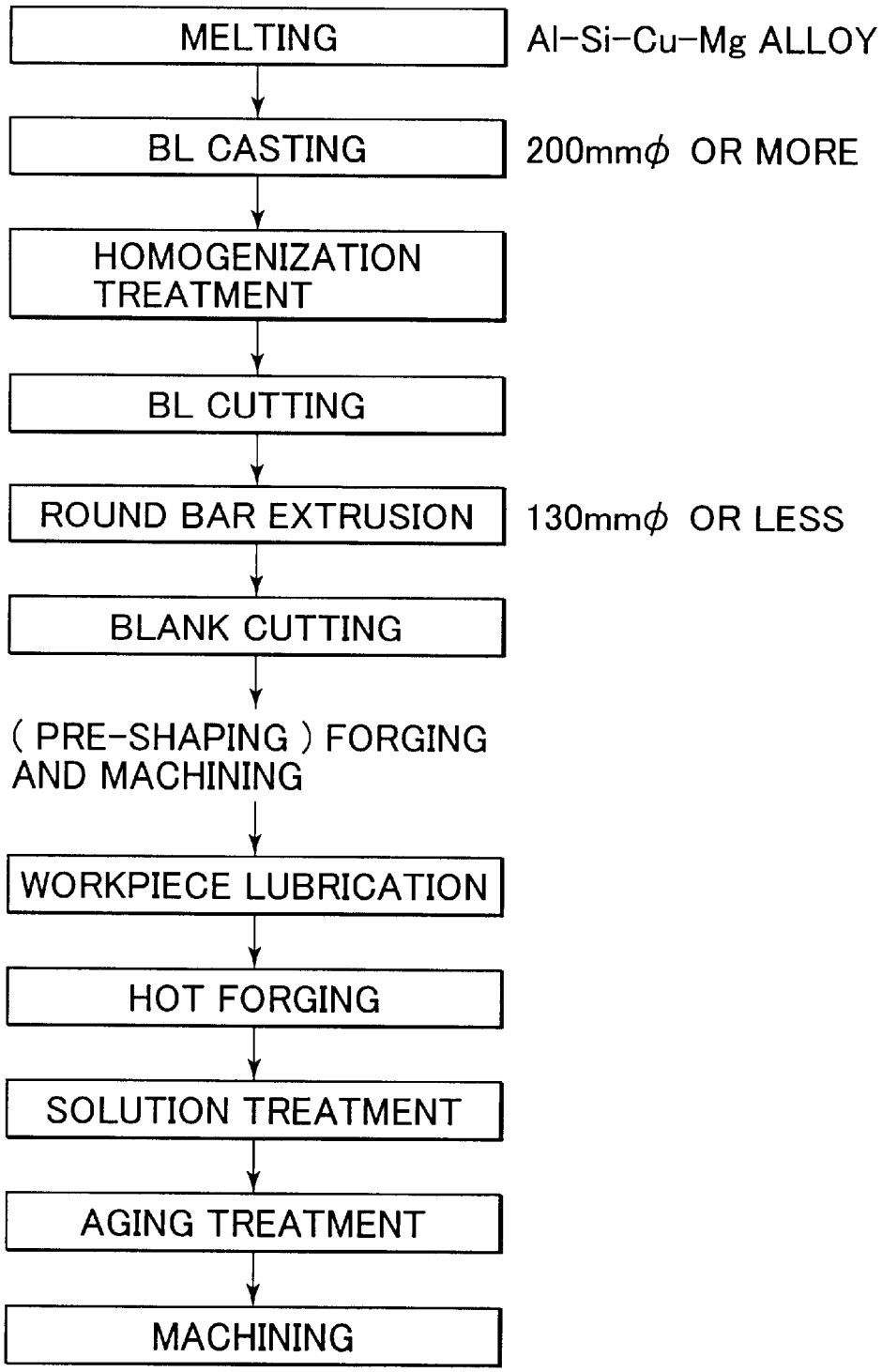
FIG. 3 is a flow chart showing a conventional process for producing a forged scroll part.

The aluminum alloy scroll is usually produced from an Si-containing aluminum alloy in order to impart wear resistance to the scroll. Crystallization of fine particles of added Si enhances wear resistance of the scroll against another scroll.

The aluminum alloy used in forging a scroll part of the present invention comprises 8.0–12.5 mass % of Si, 1.0–5.0 mass % of Cu and 0.2–1.3 mass % of Mg.

When the content of Si in the alloy is about 11 mass % or less, fine eutectic Si particles having a size of several pm dispersedly crystallize in the Al base in proportion to the content of Si, and the Si particles enhance wear resistance of the alloy scroll. Therefore, the content of Si is preferably high. When the content of Si in the alloy is less than 8.0 mass %, a sliding part such as a scroll formed from the alloy exhibits unsatisfactory wear resistance.

In contrast, when the content of Si in the alloy is in excess of 12.5 mass %, crystallization of primary Si crystals occurs. The primary Si crystals tend to become large so as to have a size as large as tens of $\mu$m. The large Si crystals cause wear of a blade during cutting and cause loss of the edge of a cutting tool during machining in post-processing, resulting in a problem in finishing. In addition, when the crystals segregate at a portion in the vicinity of the outer surface of a forged part, which is susceptible to stress concentration, breakage of the forged part initiates at that portion, resulting in lowering of mechanical strength. Therefore, the upper limit of Si content is set to be 12.5 mass %.

When Cu is added to the aluminum alloy in an amount of several %, strength of the Al base is enhanced through post heat treatment. Addition of Cu also contributes to enhancement of wear resistance of the alloy. However, when the content of Cu in the alloy is less than 1.0 mass %, Cu does not contribute to enhancement of strength of the alloy; whereas when the content of Cu is in excess of 5.0 mass %, Cu does not contribute to enhancement of strength of the alloy commensurate with the content of Cu. Therefore, the content of Cu is set to be 1.0–5.0 mass %.

Mg combines with Si, precipitating in the form of $Mg_2Si$ in the alloy after heat treatment, and this precipitation contributes to hardening of the alloy. Also, Mg forms MgSiCu through precipitation after heat treatment, and the compound contributes to hardening of the alloy. Such Mg compounds enhance the strength of the alloy. When the content of Mg is less than 0.2 mass %, Mg fails to exert such an effect; whereas when the content of Mg is in excess of 1.3 mass %, the effect of Mg does not increase commensurate with the content of Mg. In addition, an oxide generates and invades the alloy during casting, resulting in defects of the alloy. Therefore, the content of Mg is set to be 0.2–1.3 mass %.

The alloy of the present invention may further contain Ni in an amount of 2.0 mass % or less, if necessary. Addition of a small amount of Ni exerts an effect of enhancing heat resistance of the alloy. When the content of Ni is 0.1 mass % or less, Ni fails to exert the above effect; whereas when the content of Ni is in excess of 2.0 mass %, large crystals generate, resulting in lowering of toughness of the alloy. Therefore, the content of Ni is preferably 0.1–2.0 mass %.

In the alloy of the present invention, eutectic Si particles contribute to enhancement of wear resistance of the alloy. In order to uniformly disperse the Si particles in the alloy and to suppress generation of coarse primary Si crystals, the alloy may contain one or more species selected from among Sr, Ca, Na and Sb in a total amount of 0.5 mass % or less. Preferably, Sb is contained in an amount of 0.05–0.5 mass %, and Sr is contained in an amount of 0.005–0.05 mass %. Sr is particularly preferable, since addition of a trace amount of Sr exerts the above effect, and weight loss of the alloy due to oxidation etc. during melting is small.

FIG. 1 shows a process for producing a forged scroll part according to the present invention.

As described above, the aluminum alloy with its components adjusted is melted and subjected to continuous casting to form a round bar. In the present invention, continuous casting is performed to obtain a round bar material having a diameter of 130 mm or less in order to suppress generation of coarse primary Si crystals.

As compared with a conventional billet for extrusion having an ordinary diameter of 200 mm or more, a round bar material having a diameter of 130 mm or less, which is obtained through continuous casting, is cooled very rapidly and thus solidified rapidly. Therefore, eutectic Si particles become fine in the round bar material, and even when the content of Si is in excess of 10 mass %, coarse primary Si crystals, which generate in the conventional billet, do not generate in the round bar material. Particularly, in the case in which the aforementioned modification elements, such as Sr, Ca, Na and Sb, are added to the alloy, up to the Si content of 12.5 mass %, generation of primary Si crystals is substantially not observed in the round bar material, thus avoiding the aforementioned problem without including Si particles having a particle diameter exceeding 15 $\mu$m.

According to the process of the present invention using the alloy composition, eutectic Si particles having a size of 15 $\mu$m or more are substantially not observed, and the particle size is usually about 10 $\mu$m at most. The mean particle size is 3 $\mu$m or less. The phrase "substantially not observed" as used herein refers to "the percentage of non-observation in a field of view under a microscope is 99% or more." This means that Si particles having a size of 15 $\mu$m or more are substantially not included.

The particle size of Si may be directly determined from a photomicrograph of the round bar material. Preferably, the particle size is obtained through image processing by use of a microscope image analyzer, such as so-called Luzex, since a correct value is obtained through the technique. The term "particle size" as used herein refers to the diameter of a circle having the same area as that of the particle.

The diameter of a cast round bar material is preferably small, since the material having a small diameter is solidified rapidly. When the diameter of the material is small, eutectic Si particles in the material easily become fine, and generation of primary Si crystals is greatly suppressed. Therefore, a round bar material having a diameter of 85 mm or less is more preferable as a cast material, in consideration of the fact that such a material exhibits excellent upsetting effect as described below.

The material of the present invention may be cast so as to have a diameter smaller than that of the outer diameter of a scroll product; the cast material is cut so as to have a length corresponding to the weight of a forged scroll part; and the cut material is subjected to upsetting so as to attain a desired diameter. The diameter of the material after upsetting is determined so as to match the outer diameter of a flange portion of the scroll product. Through cutting of the continuously cast bar material having a small diameter and upsetting of the cut material, the material exhibits improved ductility and fatigue characteristics, due to uniform dispersion of Si particles.

Upsetting of the cut round bar material may be carried out through free-forging; i.e., through application, under two punches, of pressure onto the material in a vertical direction so as to sufficiently enlarge the diameter of the material. However, upsetting of the material is preferably carried out through die-forging, in which the outer diameter of, the material is determined by a die, in order to enhance precision in the diameter and the thickness of the material and to carry out scroll forging, which is the next step, at high productivity.

During upsetting, the upsetting ratio of the material is appropriately 20–70%.

The upsetting ratio is obtained by the following formula:

Upsetting ratio (%)=100×(the area of a cross-section of the material after processing—the area of the cross-section of the material before processing)/the area of the cross-section of the material after processing=100×(the height of the material before processing—the height of the material after processing)/the height of the material before processing.

Usually, upsetting may be carried out at room temperature when the upsetting ratio is low. Preferably, upsetting is carried out after the material is heated, since the upsetting ratio can be increased. However, even in the case in which upsetting is carried out at elevated temperature, when the upsetting ratio is very high, cracking occurs on the circumferential surface of the material beyond material ductility. In addition, since the ratio of the height of the material to the outer diameter thereof becomes high, buckling of the material occurs during upsetting, and thus a high-quality upset material cannot be obtained. Therefore, in the case of the material of the present invention, the upsetting ratio is appropriately 70% or less, preferably 60% or less. When the upsetting ratio is less than 20%, the material may fail to exhibit improved ductility and fatigue characteristics. In addition, variation in characteristics of the material for forging, as described below, is not reduced satisfactorily.

When upsetting is carried out, the material is usually heated. The material may be heated before upsetting, and then subjected to upsetting. However, in order to improve the surface condition of the material during peeling and facing as described below and to enhance the shapability of the material during upsetting, the material is preferably subjected to homogenization heat treatment before upsetting. The homogenization heat treatment is appropriately carried out at 480–520° C. for 30 minutes to four hours. When the temperature is lower than 480° C., the material is not satisfactorily homogenized; whereas when the temperature is higher than 520° C., eutectic fusion occurs at boundaries between crystal particles. The temperature is preferably 495–510° C. When the treatment time is less than 30 minutes, the material is not satisfactorily homogenized; whereas when the time is in excess of four hours, eutectic Si particles tend to become large.

If necessary, the surface of the material may be subjected to peeling and facing in advance. Through peeling and facing, precision in the diameter of the material is enhanced, and the condition of the circumferential surface of a workpiece after upsetting is improved.

The process comprising casting an aluminum alloy into a round bar material having a small diameter, cutting the cast material into a stock material for forging and subjecting the stock material to upsetting, thereby forming a workpiece has the following three advantages.

A first advantage is that generation of primary Si crystals is suppressed and eutectic Si particles become fine in the cast material, since the material is cooled rapidly as described above. When the cast material is subjected to plastic working to some extent, the material exhibits improved ductility and fatigue characteristics.

A second advantage will be described in relation to the following reason.

Variation in the length of the cut cast round bar material leads to variation in the volume (weight) of the stock material for forging, which results in variation in the height of a wrap portion of a forged scroll part. The cast round bar material is usually cut with a round sawing machine. When the cast round bar has a small diameter, the material is accurately fed in the sawing machine so as to determine the length of the material, and thus variation in the length of the cut material tends to be low. In addition, when the diameter of the cast round bar material is small, the area of the cross section of the material is small. Therefore, even if variation in the length (thickness) of the material occurs, the variation in the volume (weight) of the material is low as compared with that in a material having a larger diameter. That is, when the diameter of the cast round bar material is small, variation in the volume (weight) of the stock material for forging becomes low, resulting in low variation in the height of a wrap portion of a forged scroll part.

A third advantage is enhancement of material-based yield.

When the round bar material having a predetermined length is cut into stock materials for forging, unwanted pieces are obtained from both ends of the bar material, and powdery chips are generated. The amount of loss of the material attributed to the powdery chips is determined by the thickness of a cutting blade and the diameter of the round bar material. That is, when different stock materials having the same volume are cut from round bar materials having different diameters, the amount of powdery chips which are formed when a stock material is cut from a round bar material having a large diameter is larger than that of powdery chips which are formed when a stock material is cut from a round bar material having a small diameter. Therefore, when a stock material for forging is cut from a round bar material having a small diameter, loss of the material is reduced, with the result that the stock material for forging can be obtained at high yield, which leads to an economical benefit.

In view of the foregoing, when the upsetting ratio is low during upsetting of the stock material for forging, the aforementioned advantages are obtained to an unsatisfactory degree. Therefore, the upsetting ratio is 20% or more, preferably 40% or more.

A pre-shaped material which has undergone the aforementioned upsetting; i.e., a workpiece, is subjected to hot forging. The diameter of the workpiece is determined so as to match the outer diameter of a flange portion of a scroll part.

Such an aluminum alloy material is subjected to hot forging at 300–450° C., preferably at 350–450° C. When the hot forging temperature is very low, the material fails to be formed into a predetermined shape or cracking occurs in the material, whereas when the temperature is very high, swelling or buckling of the material may occur.

When a workpiece is subjected to hot forging, a lubricant is usually applied to the workpiece and the die in order to prevent seizing of the workpiece into a forging die. In general, when an aluminum alloy material is subjected to hot forging, a liquid lubricant containing a mixture of graphite and water or mineral oil is widely employed. Usually, when a workpiece is forged into a product having a simple shape, satisfactory lubrication and release effects are obtained through mere spraying of a lubricant directly onto a forging die. However, in the case in which a workpiece is forged into a product having a complicated shape, when lubrication is not carried out thoroughly, a lubricant becomes short, and thus the workpiece is forged into a poorly-shaped product, or the workpiece penetrates into a die and cannot be forged into the product. In order to solve such problems, a workpiece is immersed into a liquid lubricant in advance so as to coat the workpiece with a lubrication film. When a workpiece is forged into a scroll having a complicated shape, the workpiece is forged in a die having a wrap-shaped deep groove so as to form a wrap portion having a large height. Therefore, since a lubricant fails to prevail over the entirety of the wrap-contoured inner walls of the die when only spraying is carried out, shaping and release of the workpiece is not satisfactorily carried out; i.e., forging of the workpiece is difficult. In order to solve such a problem, preliminary immersion of the workpiece into the lubricant is carried out in combination with spraying of the lubricant onto the die. As a result, improved lubrication and release effects are obtained, and forging at high productivity is realized.

In order to coat a workpiece with lubrication film, a solution prepared by mixing a solvent with a graphite lubricant is applied to the workpiece. In order to increase productivity, a lubricant prepared by diluting the solution with a rapid-drying solvent is applied or sprayed to the workpiece.

In a most economical process, a lubricant is prepared by mixing graphite powder with. and dispersing it into water serving as a solvent, a workpiece is heated and then immersed into the lubricant, and the resultant workpiece is dried. In this case, the workpiece must be heated at a temperature at which water serving as a solvent is evaporated or dried within a very short time. When the heating temperature of the workpiece is lower than the boiling point of water, the lubricant fails to dry and remains on the workpiece after immersion of the workpiece, failing to rapidly dry the lubricant. Therefore, the heating temperature of the workpiece must be 100° C. or higher. In consideration of productivity, the heating temperature is preferably 130° C. or higher. The upper limit of the heating temperature may be a temperature at which deterioration of the workpiece, such as melting, does not occur. Briefly, the heating temperature is 500° C. or lower, preferably 450° C. or lower. The workpiece is usually heated in a heating furnace. Alternatively, the residual heat of the workpiece after hot upsetting may be utilized. That is to say, the workpiece can be immersed into a lubricant immediately after upsetting. In this case, a film of lubricant is formed onto the workpiece that has undergone upsetting, and the workpiece is removed from the lubricant and then dried.

Through this procedure, cutting, heating, upsetting, lubrication and forging may be carried out successively, resulting in high productivity.

Upsetting and forging may be carried out simultaneously in a single pressing apparatus. In this case, continuous production of scroll parts is possible through carrying out cutting, heating, lubrication, upsetting and forging successively.

Figure 5:
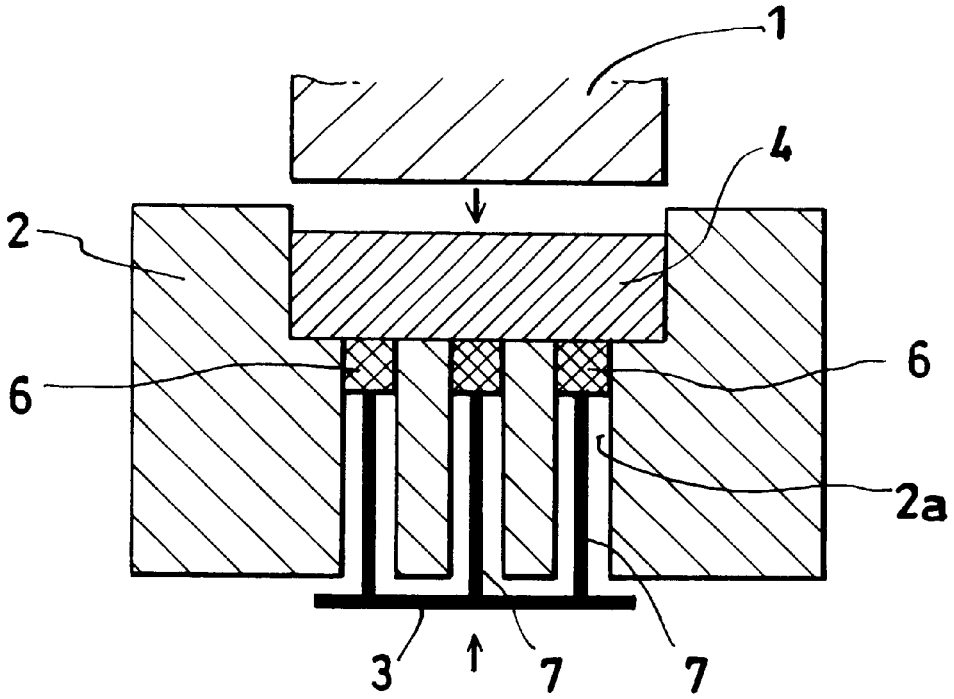
FIG. 5 is a cross section showing a scroll part according to the present invention assumed before the forging step of a forging process.
Figure 6:
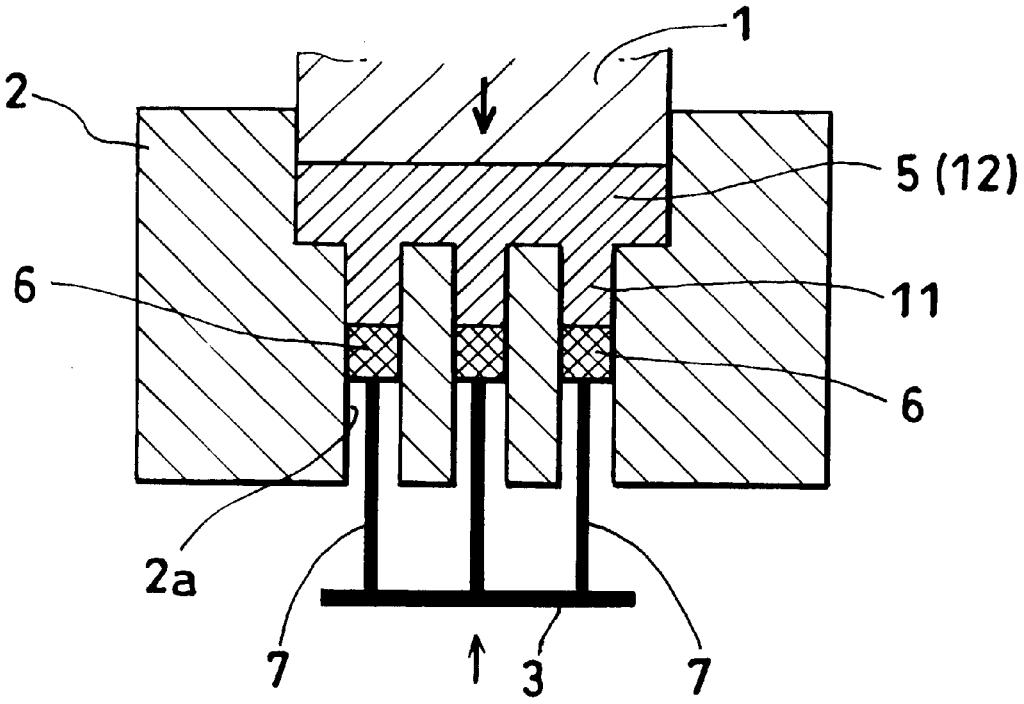
FIG. 6 is a cross section showing a scroll part according to the present invention assumed during the forging step of the forging process.
Figure 7:
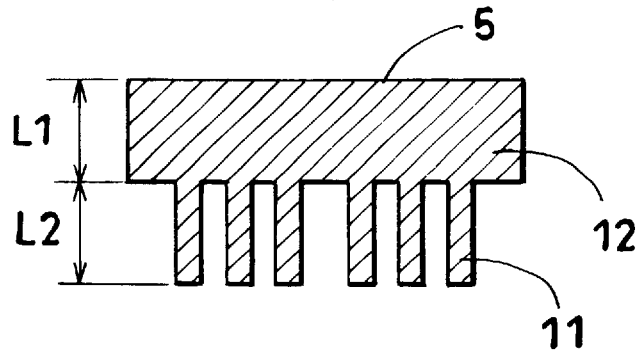
FIG. 7 is a cross section showing a forged scroll part.

A workpiece that has undergone upsetting and lubrication is forged into a scroll as follows. The workpiece 4 additionally heated, when necessary, is pressed downward with a punch 1 into a die space 2*a* to thereby form a wrap portion downward in the die space 2*a* (FIG. 6). Before the workpiece is pressed with the punch 1, knockouts 6 connected through knock pins 7 to a back pressure apparatus are inserted, in advance, in the die space 2*a* for forming a wrap, such that the knockouts 6 reach the vicinity of the upper end of the die space 2*a* (FIG. 5). When the workpiece is pressed into the die space 2*a* to form a wrap, pressure is applied to the end of the wrap in a direction opposite to the pressing direction from the back pressure apparatus through a back pressure plate 3, the knock pins 7 and the knockouts 6 to thereby form the wrap having a uniform height.

Figure 9:
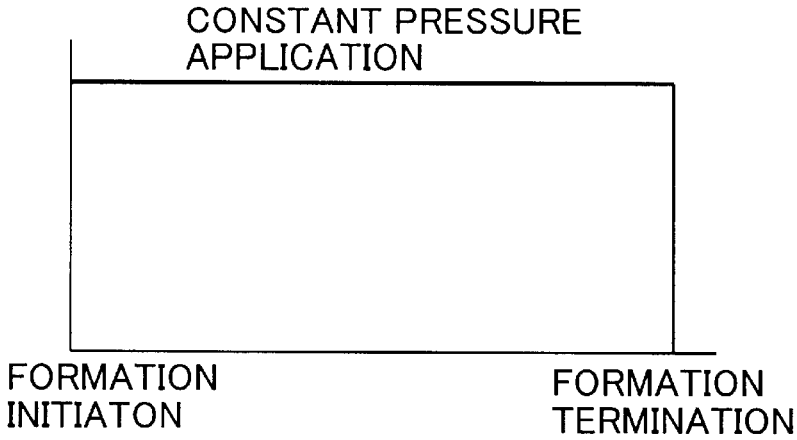
FIG. 9 is a pattern diagram showing a constant back-pressure load applied to the end portion of a wrap.

When no back pressure is applied, the amount of the molten metal poured into the wrap-forming portions in the die in the forging step is liable to be not uniform. The back pressure is applied in order to make the amounts of molten metal poured into the wrap-forming portions more uniform. The amount of the back pressure can be determined such that the amount of the molten metal poured into the wrap-forming portions can be uniformly regulated. By appropriately applying the back pressure, the amounts of the molten metal poured into the wrap-forming portions are made uniform, resulting in a product having wrap portions uniform in height. When the back pressure is very high, buckling of the wrap occurs during wrap formation, and a good product is not obtained. Therefore, when a forged part such as a scroll is formed at the aforementioned heating temperature, provided that the ratio of the horizontal cross-sectional area of a wrap portion to that of a flange portion is about ⅓ to ⅕ and that the height of the wrap portion is 4 to 10 times the thickness of the wrap portion, the surface pressure applied to the end of the wrap is constant in an appropriate range of 40–120 $N/mm^2$, preferably 60–100 $N/mm^2$, as shown in FIG. 9.

Figure 8:
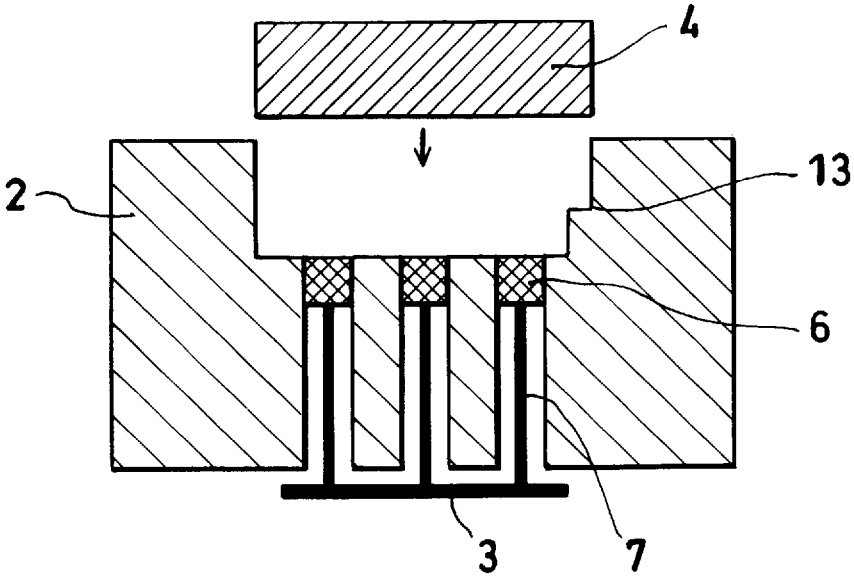
FIG. 8 is a cross section showing a die for forming a concave portion in a flange of the scroll part.
Figure 10:
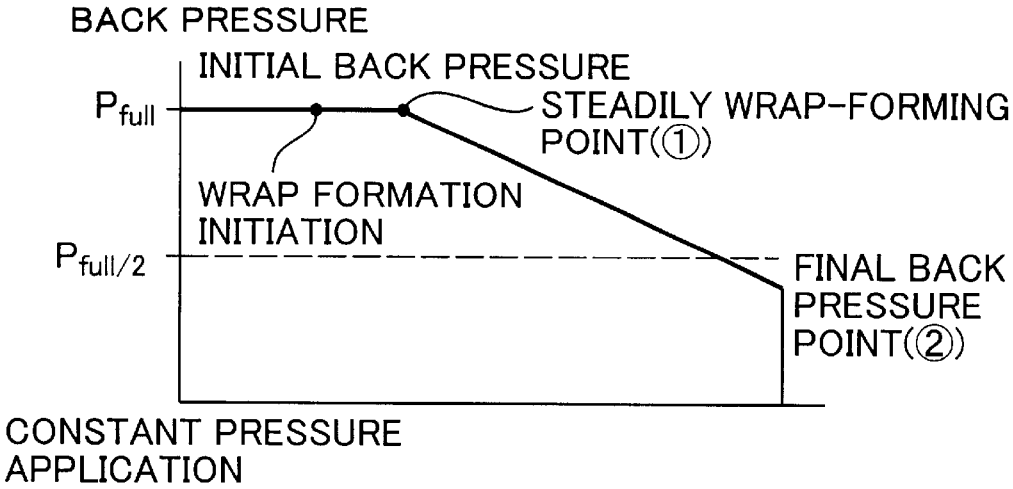
FIG. 10 is a pattern diagram showing a back-pressure load gradually reduced in a predetermined time.
Figure 11:
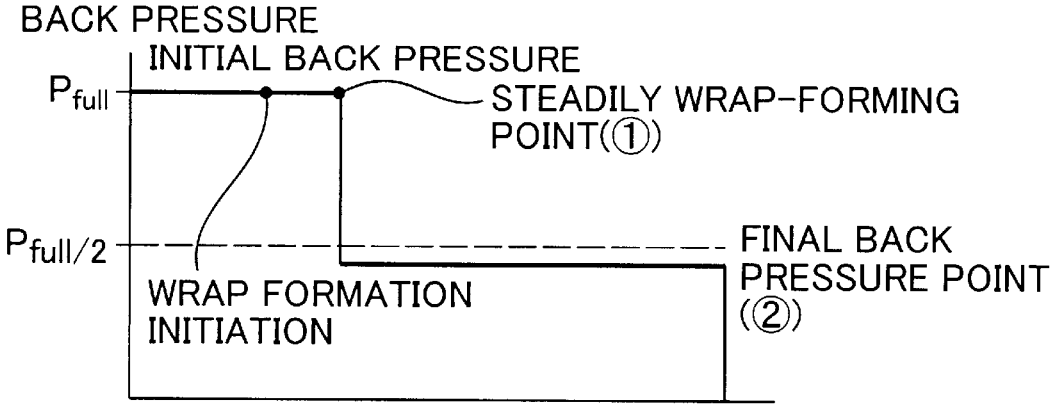
FIG. 11 is a pattern diagram showing a back-pressure load abruptly reduced in a predetermined time.

When a die for forming a flange has a concave portion 8, as shown in FIG. 8, the back pressure is preferably varied from the initial back pressure (Pfull). When particularly using a die having a concave portion at a position within 20 mm (preferably with 10 mm) apart from the wrap portion, the back pressure is preferably varied. This is because the variation in the back pressure can suppress deterioration of a filling ratio of the concave portion due to attractive flow of the molten metal into the wrap-forming portions. Patterns of the back pressure load in this case are as shown in FIGS. 10 and 11.

The workpiece 4 to which a high back pressure (Pfull) has initially been applied is inserted into the die and pressed with the punch 1. In this state, a flange portion is preferentially formed because movement of the workpiece to the wrap-forming portions in the die is suppressed.

The back pressure condition at this time is to exert a load that can suppress the movement of the workpiece to the wrap-forming portions. As a result of the studies, it has been found that the back pressure should be twice or more the conventional back pressure. Since excessively high back pressure suppresses the movement of the workpiece to the wrap-forming portions after the workpiece is filled in the shape of a flange, the back pressure is appropriately 80–240 $N/mm^2$ that is 2 to 4 times, preferably 120 to 200 $N/mm^2$.

When the workpiece has been filled in the shape of a flange, it depresses the knockouts backed up by the back pressure to move to the wrap-forming portions in the die while receiving the back pressure, thereby forming a wrap portion. The back pressure is lowered at the stage of forming the wrap portion to some extent. This timing is appropriately when the wrap portion initiates uniform-height formation. This is because the wrap portion initiates non-uniform formation before the initiation of uniform-height formation. While a concrete timing depends on the shape of a scroll product to be forged, when a scroll wrap for a compressor has a thickness of 5.0–6.0 mm and a height of 30–45 mm, it is appropriate that the length of the wrap portion is 1.0–2.0 D the thickness (D) of the wrap portion. In this case, therefore, the timing is desirably when the wrap portion is formed to have a height of 5–10 mm.

It is noted that the final pressure at the formation completion should be less than the deformation stress of the workpiece. Since the deformation stress is a stress toward the wrap-forming portions, when the back pressure is less than the deformation stress, the workpiece moved to the wrap-forming portions will not be deformed by the back pressure. For this reason, the precision of forming the wrap portion can be heightened. Briefly, the final pressure is appropriately 40–120 N/mm$^2$, preferably 60–100 N/mm$^2$.

The pressure-lowering method requires that the back pressure pass through the steadily wrap-forming point (①() and the final back pressure point (②) as shown in FIG. 10. The gradually pressure-lowering method rather than the abruptly pressure-lowering method shown in FIG. 11 is preferable because it can more stabilize the precision of wrap formation. It is desirable that the back pressure be proportionately lowered as shown in FIG. 10.

This back pressure control allows the flange formation to preferentially proceed at the initial stage, preventing defects in the concave portion at the suction port of the flange portion. Lowering the back pressure at the stage at which the wrap portion is being steadily formed can suppress local swelling and variation in shape of the wrap portion and avoid buckling of the wrap portion due to a high back pressure. For this reason, the present invention does not require formation of gradients for die-removal on the wrap-forming portions that has heretofore been done.

In order to impart strength and wear resistance to the forged scroll part having the wrap portion with the predetermined height, the scroll part is preferably subjected to solution and aging treatment. The solution and aging treatment comprises heat-treating the scroll part to a predetermined temperature, then quenching it, and leaving it standing at a different predetermined temperature for a predetermined period of time. For example, the solution temperature is preferably 490–500° C. After the scroll part is subjected to quenching in water, it is subjected to aging for hardening under appropriate conditions, e.g. at a temperature of 160–210° C. (preferably 170–190° C.) for a period of 1–8 hours (preferably 3–6 hours). Through this procedure, the scroll part is imparted with a satisfactory hardness of about HRB 70–85.

The heat-treated forged scroll part is further subjected to machining, if necessary, so as to precisely regulate the height and the shape of the wrap portion. The thus-produced scroll part can be incorporated into a compressor or the like.

The present invention will next be described with reference to Examples, but is not limited to the Examples.

EXAMPLES

Production of a Workpiece for Forging, of the Present Invention

Alloy materials A through F having compositions shown in Table 1 were employed in Examples 1 through 8, and alloy materials G and H each having a Si content falling outside the range of the present invention were employed in Comparative Examples 5 and 6. Each alloy material was cast into a bar having a diameter of 82 mm and a length of 5,000 mm, through continuous casting at a casting rate of about 300 mm/minute. The cast bar was subjected to homogenization heat treatment at 500° C. for one hour and then subjected to facing by use of a peeling machine so as to attain a diameter of 78 mm.

Subsequently, the bar was cut with a round sawing machine with a saw thickness of 2.5 mm into workpieces each having a thickness of 65 mm.

Each cut workpiece heated to about 400° C. in a heating furnace was subjected to upsetting through die-forging with a 630-ton press machine so as to obtain a disc-shaped, upset substance (workpiece) having a diameter of 114 mm. The upsetting ratio was 53% obtained from the following calculation: upsetting ratio=$\{1-(78/114)^2\}\times100=53\%$.

When the bar was cut into workpieces, 45 g of chips per workpiece were formed.

TABLE 1

Size of forged alloy material subjected to test and back-pressure conditions

| Alloy | Test | Chemical analysis value (wt %) | | | | | | | Stock material for forging | | Forging back pressure |
|---|---|---|---|---|---|---|---|---|---|---|---|
| | | Si | Cu | Mg | Ni | Sb | Sr | Others | Diameter | working | N/mm$^2$ |
| A | Example 1 | 10.2 | 2.9 | 0.5 | — | — | — | Bal. | φ82 | Upsetting | 80 |
| | Example 2 | 10.2 | 2.9 | 0.5 | — | — | — | Bal. | φ82 | Upsetting | 40 |
| | Example 3 | 10.2 | 2.9 | 0.5 | — | — | — | Bal. | φ82 | Upsetting | 120 |
| | Comp. Ex. 1 | 10.2 | 2.9 | 0.5 | — | — | — | Bal. | φ82 | Upsetting | 30 |
| | Comp. Ex. 2 | 10.2 | 2.9 | 0.5 | — | — | — | Bal. | φ82 | Upsetting | 130 |
| B | Example 4 | 11.5 | 4.5 | 0.6 | — | — | — | Bal. | φ82 | Upsetting | 80 |
| | Comp. Ex. 3 | 11.5 | 4.5 | 0.6 | — | — | — | Bal. | φ200 | Extrusion | 80 |
| C | Example 5 | 10.4 | 2.6 | 0.3 | — | — | — | Bal. | φ82 | Upsetting | 80 |
| | Comp. Ex. 4 | 10.4 | 2.6 | 0.3 | — | — | — | Bal. | φ200 | Extrusion | 80 |

TABLE 1-continued

Size of forged alloy material subjected to test and back-pressure conditions

| Alloy | Test | Chemical analysis value (wt %) Si | Cu | Mg | Ni | Sb | Sr | Others | Stock material for forging Diameter | working | Forging back pressure N/mm$^2$ |
|---|---|---|---|---|---|---|---|---|---|---|---|
| D | Example 6 | 8.9 | 2.1 | 0.4 | — | 0.22 | — | Bal. | φ82 | Upsetting | 80 |
| E | Example 7 | 12.0 | 1.2 | 1.1 | 1.2 | 0.25 | — | Bal. | φ82 | Upsetting | 80 |
| F | Example 8 | 11.2 | 4.6 | 0.7 | — | — | 0.01 | Bal. | φ82 | Upsetting | 80 |
| G | Comp. Ex. 5 | 13.1 | 4.8 | 0.5 | — | — | — | Bal. | φ82 | Upsetting | 80 |
| H | Comp. Ex. 6 | 7.0 | 0.3 | 0.2 | — | — | — | Bal. | φ82 | Upsetting | 80 |

Production of a Workpiece for Forging by a Conventional Process

Alloy materials B and C shown in Table 1, i.e. those of Examples 4 and 5, were employed in Comparative Examples 3 and 4. Each alloy material was cast into a billet for extrusion having a diameter of 200 mm through continuous casting at a casting rate, of about 150 mm/minute. The billet was subjected to homogenization heat treatment at 500° C. for one hour, and then extruded into a stock material having an outer diameter of 114 mm, which is equal to that of the above upset workpiece. The stock material was cut with a round sawing machine with a saw thickness of 2.5 mm into workpieces having a thickness of 30.4 mm, such that the volume of each workpiece was the same as that of the above upset workpiece.

When the stock material was cut into workpieces, 80 g of chips per workpiece were formed. The amount of loss of the material was about twice that of loss of the material in the cases of Examples 1 through 8 in which the round bar obtained through continuous casting was cut into workpieces.

Observation of Internal Metallographical Structure of a Workpiece for Forging Subsequently, in order to observe the internal metallographical structure of each of the above-prepared workpieces or to measure the size and the weight of the workpiece, 10 upset workpieces or 10 cut workpieces were collected as samples.

After the sizes and weights of these 10 workpieces were measured, a 20 mm-square sample was cut out of the center portion of each workpiece, and the internal microstructure of the sample was observed. Through this observation, the existence of primary Si crystals, the size and number of the crystals and the size of eutectic Si particles were measured. The weight of each sample was measured by use of an even balance. The thickness of each sample was measured at two points per sample by use of a micrometer. The results are shown in Table 2. The maximum and minimum values of the weight and thickness are shown in respect of 10 samples.

TABLE 2

Metallographical observation and size measurement of workpiece for forging

| | Alloy | Test | Internal microstructure: Primary Si crystal Number | Maximum size (μm) | Eutectic Si particle Mean size (μm) | Maximum size (μm) | Size Diameter (mm) | Thickness (mm) | Note Weight measured (g) |
|---|---|---|---|---|---|---|---|---|---|
| Example | A | Ex. 1 | None | — | 2.0 | 4.8 | 114.0 | 30.40–30.49 | 841–843 |
| | B | Ex. 4 | None | — | 2.1 | 6.7 | 114.0 | 30.35–30.51 | 845–848 |
| | C | Ex. 5 | None | — | 2.0 | 4.4 | 114.0 | 30.38–30.52 | 840–842 |
| | D | Ex. 6 | None | — | 1.9 | 4.4 | 114.0 | 30.37–30.50 | 839–842 |
| | E | Ex. 7 | None | — | 2.1 | 7.2 | 114.0 | 30.42–30.52 | 841–843 |
| | F | Ex. 8 | None | — | 2.1 | 5.3 | 114.0 | 30.44–30.51 | 845–847 |
| Comparative Example | B | Comp. Ex. 3 | 5 | 100 | 2.5 | 10.3 | 114.0 | 30.20–30.58 | 844–850 |
| | C | Comp. Ex. 4 | 2 | 52 | 3.0 | 15.5 | 114.0 | 30.33–30.63 | 840–845 |
| | G | Comp. Ex. 5 | 5 | 110 | 2.0 | 8.4 | 114.0 | 30.37–30.46 | 845–848 |
| | H | Comp. Ex. 6 | None | — | 1.8 | 4.8 | 114.0↑ | 30.41–30.49 | 840–842 |

The results reveal that when a workpiece is subjected to upsetting, coarse primary Si crystals are not formed in the workpiece, variation in the size and weight of the workpiece is reduced, loss of the material resulting from cutting is small and production yield is improved. Thus, a highly reliable workpiece exhibiting high precision in size can be produced economically.

Scroll Forging

Subsequently, the above upset workpiece and the above extruded-and-cut workpiece were heated at 200° C. in a heating furnace, and then each workpiece was immersed into a water-containing graphite lubricant for several seconds and removed therefrom to thereby coat the workpiece with a lubrication film. While the workpiece was heated to 400° C., the workpiece was subjected to forging at a punch pressure of 450 tons and at a back surface pressure of 40–120 N/mm$^2$ to thereby produce a scroll having a flange diameter of about 115 mm, a flange thickness of about 23.0 mm, a wrap height of 39.6 mm and a wrap thickness of 5.7 mm. The ratio of the horizontal cross-sectional area of the flange to that of the wrap was about 4.0.

The upset workpieces of Comparative Examples 1 and 2, obtained from alloy material A, were subjected to forging at back pressures of 30 and 130 N/mm$^2$, respectively.

Under the aforementioned conditions, 50 workpieces of each Example and each Comparative Example were successively subjected to forging to thereby produce 50 scroll parts. Difference in the height (the maximum height minus the minimum height) of the scroll wrap of each forged part was measured to thereby obtain variation in wrap height difference between the 50 forged parts. In addition, there was measured the height of the wrap of each forged part at three points (a spiral initiation point 11*a*, a spiral termination point 11*c* and a point 11*b* on a line joining the points 11*a* and 11*c* and adjacent to the point 11*c* in FIG. 1) to thereby obtain variation in mean wrap height between the 50 forged parts. Furthermore, the shape of the wrap of each forged port was observed.

The results are shown in Table 3. The results reveal that when the back pressure is 30 N/mm$^2$, the difference in wrap height of one forged part is in excess of 1 mm. This shows that the height of the wrap becomes non-uniform when the back pressure is low. In contrast, when the back pressure is 130 N/mm$^2$, buckling of the wrap occurs, and a good forged part is not produced.

TABLE 3

Size measurement and observation of forged part in each test

| | Alloy | Test | Workpiece | Back pressure condition N/mm$^2$ | Difference in wrap height in one forged part/mm (Max.–Min.) | 50 Forged parts Mean wrap height/mm Minimum | Maximum | Note |
|---|---|---|---|---|---|---|---|---|
| Example | A | Ex. 1 | Upset piece | 80 | 0.3 to 0.4 | 39.4 | 39.7 | |
| | | Ex. 2 | Upset piece | 40 | 0.3 to 0.5 | 39.0 | 39.4 | |
| | | Ex. 3 | Upset piece | 120 | 0.2 to 0.4 | 39.2 | 39.5 | |
| | B | Ex. 4 | Upset piece | 80 | 0.3 to 0.4 | 39.2 | 39.6 | |
| | C | Ex. 5 | Upset piece | 80 | 0.3 to 0.4 | 39.4 | 39.7 | |
| | D | Ex. 6 | Upset piece | 80 | 0.3 to 0.4 | 39.2 | 39.7 | |
| Comparative Example | A | Comp. Ex. 1 | Upset piece | 30 | 1.3 to 2.0 | — | — | Variation in wrap height occurs. |
| | | Comp Ex. 2 | Upset piece | 130 | 0.2 to 0.4 | 39.0 | 39.3 | Buckling of wrap occurs. |
| | B | Comp. Ex. 3 | Extruded piece | 80 | 0.3 to 0.5 | 38.2 | 39.8 | |
| | C | Comp. Ex. 4 | Extruded piece | 80 | 0.3 to 0.5 | 38.4 | 39.7 | |

The results further reveal that variation in mean wrap height between forged parts produced from workpieces obtained through the conventional process including extrusion and cutting is 1.0 mm or more. That is, as shown in Table 2, variation in volume between the workpieces causes variation in wrap height between the forged parts.

According to the present invention, however, variation in height of the wrap of one forged part falls within 0.5 mm, and variation in mean wrap height between forged parts also falls within 0.5 mm. That is, a forged part having a good shape can be produced.

Figure 12:
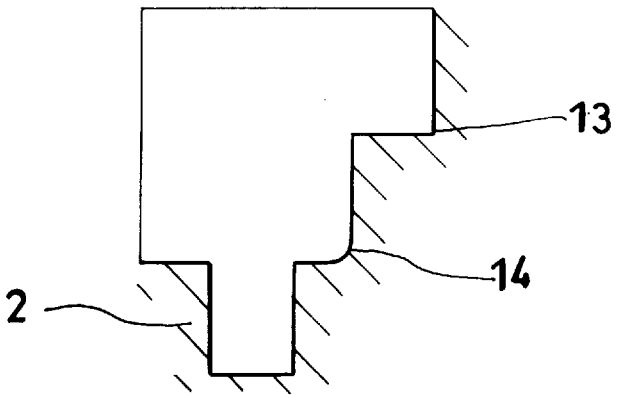
FIG. 12 is a cross section showing a die for forming two stepped portions on the flange of the scroll part.

Subsequently, forging was carried out using a die with two steps 13 and 14 as shown in FIG. 12, the lower one of which was rounded to have R of 2.0 mm, while varying the back-pressure load pattern. The shape of the forged part transferred was measured. The height of the wrap was measured at five points, and the difference between the maximum value and the minimum value was evaluated as variation in wrap height. The workpieces used were the same as those in Example 1.

The back-pressure patterns used were a pattern of constant-pressure load applied throughout the formation as shown in FIG. 9, a pattern (A) of the back pressure made high at the initial stage and gradually reduced as shown in FIG. 10 and a pattern (B) of the back pressure made high at the initial stage and abruptly reduced in a predetermined time as shown in FIG. 11. When the filling ratio of the die was good, R of the concave portion shape of a product would be the same as R of the die. When the filling ratio was insufficient, however, R of a product would become large because a gap was formed between the inside wall surface of the die and a product being produced.

The results are as shown in Table 4 below. The results reveal that the back-pressure load pattern (A) enables the shape of the concave portion to be transferred with high precision, compared with the conventional back-pressure load pattern, and shows good height of the wrap and that the back-pressure load pattern (B) shows goods formation of the concave portion and slightly large variation in wrap height.

TABLE 4

| Back-pressure pattern | Shape of forged part according to back-pressure patterns: Concave portion shape (mm) | Wrap variation (mm) |
|---|---|---|
| Constant pattern | R 3.0 | <0.3 |
| Pattern A | R 2.0 | <0.3 |
| Pattern variation B | R 2.0 | 0.5–0.3 |

Subsequently, 10 forged parts of each of Examples 4 and 5 and Comparative Examples 3 through 6 were heated at 500° C., and then subjected to quenching in water. Subsequently, the parts were subjected to aging treatment at 180° C. for six hours. Thereafter, a tensile test piece was obtained from each forged part, and tensile characteristics of the forged part were evaluated. In addition, the side wall of the wrap of each forged part was machined about 0.5 mm by use of an end mill, and then the machined surface was observed. Furthermore, the workpiece for forging was subjected to heat treatment in a manner similar to that of the above procedure, and a fatigue test piece was obtained from the workpiece. The fatigue test piece was subjected to a test by use of an Ono-type rotating bending fatigue test apparatus, and fatigue characteristics of the workpiece were evaluated on the basis of breakage stress at $10^7$ cycles. The results are shown in Table 5.

TABLE 5

Mechanical characteristics and machining test of forged part

| | Alloy | Test | Tensile characteristics (room temperature): 0.2% proof stress (MPa) | Tensile strength (MPa) | Fracture elongation (%) | Fatigue characteristics (room temperature) $10^7$ cycle (MPa) | Observation of machined surface |
|---|---|---|---|---|---|---|---|
| Example | B | Ex. 4 | 401 | 456 | 6.3 | 210 | No tool scratch |
| | C | Ex. 5 | 322 | 403 | 13.8 | 190 | No tool scratch |
| Comparative Example | B | Comp. Ex. 3 | 408 | 448 | 3.2 | 180 | Tool scratches |
| | C | Comp. Ex. 4 | 330 | 415 | 10.8 | 165 | Tool scratches |
| | G | Comp. Ex. 5 | 410 | 458 | 3.8 | 170 | Tool scratches |
| | H | Comp. Ex. 6 | 200 | 301 | 15.1 | 130 | No tool scratch |

The results reveal that when an upset stock material is employed as a workpiece, the fracture elongation of the workpiece is improved, and thus a forged part exhibiting high fatigue strength and having an excellent machined surface is produced. That is, it is found that when formation of coarse primary Si crystals is suppressed, the above effects are obtained.

In order to confirm the internal metallographical structure of the forged part, a test piece was cut out from the central portion of the forged part of each of Examples 1 through 8 after aging treatment, and the test piece was subjected to observation of microstructure. Consequently, primary Si crystals were not observed in each test piece, and change in the size of eutectic Si particles attributed to forging and heat treatment was not confirmed.

In Comparative Examples 5 and 6, in which the Si content of the alloy material falls outside of the range of the present invention, scratches were formed on the machined surface of a forged part, the scratches being attributed to formation of primary Si crystals, and the strength of the forged part was lowered. Such a forged part is not suitable for a scroll.

Industrial Applicability

According to the alloy material and the forging process of the present invention, variation in wrap height of one forged scroll can be reduced and variation in mean wrap height between forged scrolls can also be reduced. In addition, there can be mass-produced aluminum alloy-made forged scrolls, with formation of primary Si crystals causing lowering of strength of the scroll and adversely affecting machining of the scroll suppressed.

What is claimed is:

1. A process for producing an aluminum alloy-made forged scroll part, which comprises a step of casting an aluminum alloy material into a round bar having a diameter of 130 mm or less, the aluminum alloy material comprising 8.0–12.5 mass % of Si, 1.0–5.0 mass % of Cu and 0.2–1.3 mass % of Mg; a step of cutting the aluminum alloy round bar into a stock material for forging; a step of subjecting the stock material to upsetting at an upsetting ratio of 20–70% to formn a pre-shaped product that is a workpiece; and a forging step of applying pressure onto the workpiece with a punch at a temperature of 300–450° C. to form a scroll wrap in a direction of the punch pressure, and wherein the forging step includes a single step in which a forged scroll part is press-formed while a back pressure smaller than the punch pressure is applied to an end of the scroll wrap in a direction opposite to the punch pressure direction.

2. The process for producing an aluminum alloy-made forged scroll part according to claim 1, wherein the step of casting an aluminum alloy material into a round bar produces a round bar having a diameter of 85 mm or less.

3. The process for producing an aluminum alloy-made forged scroll part according to claim 1 or claim 2, wherein the aluminum alloy material further comprises 2.0 mass % or less of Ni and/or 0.5 mass % or less of one or more species selected from among Sr, Ca, Na and Sb.

4. The process for producing an aluminum alloy-made forged scroll part according to claim 1 or claim 2, wherein the back pressure is a constant pressure of 80–240 $N/mm^2$.

5. The process for producing an aluminum alloy-made forged scroll part according to claim 1 or claim 2, wherein the back pressure comprises an initial pressure of 80–240 $N/mm^2$, a pressure gradually reduced from the initiation of wrap formation and an end pressure of 40 to 120 $N/mm^2$.

6. The process for producing an aluminum alloy-made forged scroll part according to claim 1 or claim 2, wherein the stock material for forging is subjected to homogenization heat treatment at 480–520° C. for 30 minutes to four hours before being subjected to upsetting.

7. The process for producing an aluminum alloy-made forged scroll part according to claim 1 or claim 2, wherein the stock material for forging is subjected to surface peeling before being subjected to upsetting.

8. The prcess for producing an aluminum alloy-made forged scroll part according to claim 1 or claim 2, wherein the workpiece having been subjected to upsetting is subjected to lubrication film surface coating.

9. The process for producing an aluminum alloy-made forged scroll part according to claim 8, wherein the workpiece is heated at 100–500° C. and immersed into a lubricant solution prepared by mixing and dispersing graphite powder into water to subject the workpiece to lubrication film surface coating.

10. The process for producing an aluminum alloy-made forged scroll part according to claim 1 or claim 2, wherein the scroll part is subjected to solution heat treatment and aging treatment.

* * * * *